US010030427B2

(12) United States Patent
McGregor et al.

(10) Patent No.: US 10,030,427 B2
(45) Date of Patent: Jul. 24, 2018

(54) COMPACT HINGE APPARATUS AND METHOD OF USE

(71) Applicant: Hardware Resources, Inc., Bossier City, LA (US)

(72) Inventors: Dennis McGregor, Dallas, TX (US); Travis McElveen, Bossier City, LA (US)

(73) Assignee: Hardware Resources, Inc., Bossier City, LA (US)

( * ) Notice: Subject to any disclaimer, the term of this patent is extended or adjusted under 35 U.S.C. 154(b) by 100 days.

(21) Appl. No.: 15/191,100

(22) Filed: Jun. 23, 2016

(65) Prior Publication Data

US 2017/0370139 A1 Dec. 28, 2017

(51) Int. Cl.

| | |
|---|---|
| ***E05D 11/10*** | (2006.01) |
| ***E05F 3/20*** | (2006.01) |
| ***E05F 3/06*** | (2006.01) |
| ***E05D 7/00*** | (2006.01) |

(52) U.S. Cl.

CPC ..... *E05F 3/20* (2013.01); *E05D 7/0009* (2013.01); *E05D 11/10* (2013.01); *E05F 3/06* (2013.01); *E05Y 2900/20* (2013.01)

(58) Field of Classification Search

CPC ..... E05D 7/0009; E05D 7/0423; E05D 2007/0492; E05D 11/10; E05F 3/06; E05F 3/20

USPC ..... 16/235, 236, 237, 238, 240, 327, 338

See application file for complete search history.

(56) References Cited

U.S. PATENT DOCUMENTS

| | | | | |
|---|---|---|---|---|
| 6,694,567 | B1 * | 2/2004 | Domenig | E05D 7/0415 16/238 |
| 6,880,205 | B2 * | 4/2005 | Rupprechter | E05D 7/0415 16/235 |
| 6,918,158 | B2 * | 7/2005 | Isele | E05D 7/0415 16/235 |
| 7,017,231 | B2 * | 3/2006 | Isele | E05D 7/0407 16/236 |
| D523,323 | S | 6/2006 | Domenig et al. | |
| 7,213,300 | B1 * | 5/2007 | Domenig | E05D 7/04 16/236 |

(Continued)

OTHER PUBLICATIONS

"Blum Compact Face Frame Hinge with Blumotion 1 ¼" Overlay Pair," amazon.com, Oct. 2, 2012. http://www.amazon.com/BlumCompactFrameBlumotionOverlay/dp/B009KJYQHK/ref=sr_1_9? e=UTF8&qid=1452690012&sr=89&.

*Primary Examiner* — Roberta S Delisle

(74) *Attorney, Agent, or Firm* — Schultz & Associates, P.C.

(57) ABSTRACT

Disclosed is a silent, soft-close compact hinge comprising of a hinge cup pivotally connected to a hinge body via a hinge arm. A set of coil springs biases the hinge to a closed position. A damping mechanism is removably attached to the hinge cup and acted on by the hinge arm. A set of spring sleeves are fitted to the coil springs to insulate the movement of the coil springs on the hinge arm providing the closing bias. The hinge body is comprised of three separate plates adjustably connected to each other with cam screws. The position of the hinge body with respect to the hinge arm is adjustable in three directions without the need for removal or loosening of mounting hardware used to attach the hinge body to a furniture piece.

20 Claims, 8 Drawing Sheets

(56) References Cited

U.S. PATENT DOCUMENTS

| | | | | |
|---|---|---|---|---|
| 7,231,691 | B1 * | 6/2007 | Domenig | E05D 7/0407 16/236 |
| 7,516,516 | B2 | 4/2009 | Wu | |
| 7,614,116 | B2 * | 11/2009 | Chen | E05D 7/04 16/238 |
| 7,810,212 | B2 | 10/2010 | Salice | |
| 7,966,696 | B2 | 6/2011 | Krammer | |
| 8,276,241 | B2 * | 10/2012 | Wu | E05D 7/0415 16/235 |
| 8,387,213 | B2 | 3/2013 | Brunnmayr | |
| 8,650,711 | B1 | 2/2014 | Chen et al. | |
| 8,689,402 | B2 * | 4/2014 | Brunnmayr | E05F 5/006 16/286 |
| 8,925,151 | B2 | 1/2015 | Salice | |
| 9,003,605 | B2 | 4/2015 | Pecar et al. | |
| 9,163,447 | B1 | 10/2015 | Liang et al. | |
| 9,328,544 | B1 * | 5/2016 | Liang | E05F 1/1215 |
| 9,366,067 | B2 * | 6/2016 | Wu | E05F 1/1215 |
| 2004/0163211 | A1 * | 8/2004 | Rucker | E05D 7/0415 16/235 |
| 2006/0137139 | A1 * | 6/2006 | Wu | E05D 7/0415 16/236 |
| 2008/0271291 | A1 * | 11/2008 | Chen | E05D 7/0407 16/238 |
| 2013/0111701 | A1 * | 5/2013 | Salice | E05F 3/20 16/50 |
| 2014/0150204 | A1 | 6/2014 | Grummett et al. | |
| 2014/0359973 | A1 | 12/2014 | Ng | |
| 2014/0373309 | A1 | 12/2014 | Ng | |
| 2015/0240543 | A1 | 8/2015 | Ng | |
| 2015/0315832 | A1 | 11/2015 | Wu | |
| 2015/0330128 | A1 | 11/2015 | Ng | |

* cited by examiner

COMPACT HINGE APPARATUS AND METHOD OF USE

FIELD OF THE DISCLOSURE

The present disclosure relates to compact hinges for furniture products. In particular, the present disclosure relates to a compact hinge, adjustable in three directions, providing silent, soft-close functionality.

BACKGROUND OF THE DISCLOSURE

In the field of cabinetry and mill work, a recurring problem is the uncontrolled speed at which a cabinet door closes. The typical hinged connection includes a hinge cup mounted to a furniture piece and pivotally connected to a hinge arm mounted to another furniture piece. A metal coil spring biases the metal hinge cup toward the metal hinge arm. One result of the coil springs can be uncontrolled and undesired rapid closure of cabinetry doors which results in noise and impact wear of cabinet hinges and cabinet faces. Furthermore, the sliding movement of the coil spring on the metal hinge arm during operation results in unwanted noise and a "grinding" perception by a user which is undesirable.

Prior art compact hinges have attempted solutions to these problems, but have done so unsatisfactorily. The prior art suffers from various disadvantages including limited adjustability, size, complexity, durability, and high manufacturing cost.

For example, U.S. Patent Application Publication No. 2015/0315832 to Wu discloses a soft-closing hinge for use in furniture comprising a movable hinge cup coupled to a door panel and a securing member coupled to a wall panel. A hinge arm pivotally attaches the movable hinge cup to the securing member while a spring exerts an opening or closing force to the movable hinge cup. A damper disposed on the movable hinge cup, acts on the hinge arm to soft close the hinge. A cross section of at least one end of the spring is of a non-circular shape and provided with a plastic sliding member. The sliding member acts on the hinge arm when the hinge is opened and/or closed to generate an opening force or a closing force. The securing member is not adjustable in more than two directions without removing mounting hardware.

U.S. Patent Application Publication No. 2015/0240543 to NG discloses a hinge comprising a movable cup seat mounted to a furniture door body and a regulating base affixed to the main body of furniture. A rotary arm having an arc-shaped surface pivotally attaches the movable cup seat to the regulating base. The rotary arm is connected to the regulating base via a regulating screw and an eccentric regulating rivet. A torsion spring generates a start-stop acting force on the movable cup seat. A sleeve part is fitted to a first supporting leg of the torsion spring and slidably engages the arc-shaped surface. The regulating base is not adjustable in three directions without removing mounting hardware.

U.S. Pat. No. 9,163,447 to Liang, et al. discloses a hinge comprising a hinge cup, a hinge arm, a spring, and an adjustable damping device. The hinge cup is pivotally connected to the hinge arm and is mounted to the door of a cabinet. The hinge arm is mounted to the fixed portion of the cabinet. The spring and the damping device are mounted in the hinge cup. When the hinge cup is closed with respect to the hinge arm, the hinge cup is subjected to a dampened closing force via the damping device. A cover insulates the spring from the hinge arm. The hinge arm is not adjustable in more than two directions without removing mounting hardware.

Therefore, a need exists for a silent, soft-close hinge capable of providing positional adjustments in three dimensions even after mounting to cabinetry.

SUMMARY OF THE DISCLOSURE

A preferred embodiment is comprised of a hinge cup mounted in a cabinet door, a hinge body mounted to a cabinet carcass, and a hinge arm biased by a pair of coil springs. The hinge arm connects the hinge cup to the hinge body and provides a swinging connection between the cabinet door and the cabinet carcass. A damping mechanism is comprised of a housing removably fitted within the hinge cup and a piston within a fluid filled cylinder. The cylinder is slidably engaged with the housing and is acted upon by an abutment section of the hinge arm. One end of each coil spring is disposed in the hinge cup while the other end of each coil spring is fitted with a spring sleeve. The spring sleeves engage cam surfaces on the hinge arm. The hinge body is comprised of an "L" shaped overlay plate adjustably engaged with an adjustment plate adjustably engaged with a mounting plate. Three separate cam screws provide positional adjustability of the hinge body with respect to the hinge arm in three different directions. The overlay plate and the adjustment plate each include access holes aligned with a mounting hole in the mounting plate. Mounting hardware, such as a wood screw, attaches the mounting plate to the cabinet carcass.

In use, the apparatus controls the closing speed of the cabinet door. As the door closes, the abutment section of the hinge arm contacts the cylinder and forces it through the housing against the bias of the piston moving through the fluid within the cylinder. Rotation of each of the cam screws separately adjusts the position of the cabinet door in a depth direction, a vertical direction, and a horizontal or "overlay" direction without removing the mounting hardware used to mount the hinge body to the cabinet carcass. As the cabinet door is opened or closed, the spring sleeves insulate the contact area of the coil springs on the cams of the hinge arm to eliminate the noise and "grinding" generated by the movement of the springs on the hinge arm.

Those skilled in the art will appreciate the above-mentioned features and advantages of the disclosure together with other important aspects upon reading the detailed description that follows in conjunction with the drawings.

DETAILED DESCRIPTION

In the description that follows, like parts are marked throughout the specification and figures with the same numerals, respectively. The figures are not necessarily drawn to scale and may be shown in exaggerated or generalized form in the interest of clarity and conciseness.

Figure 1A:
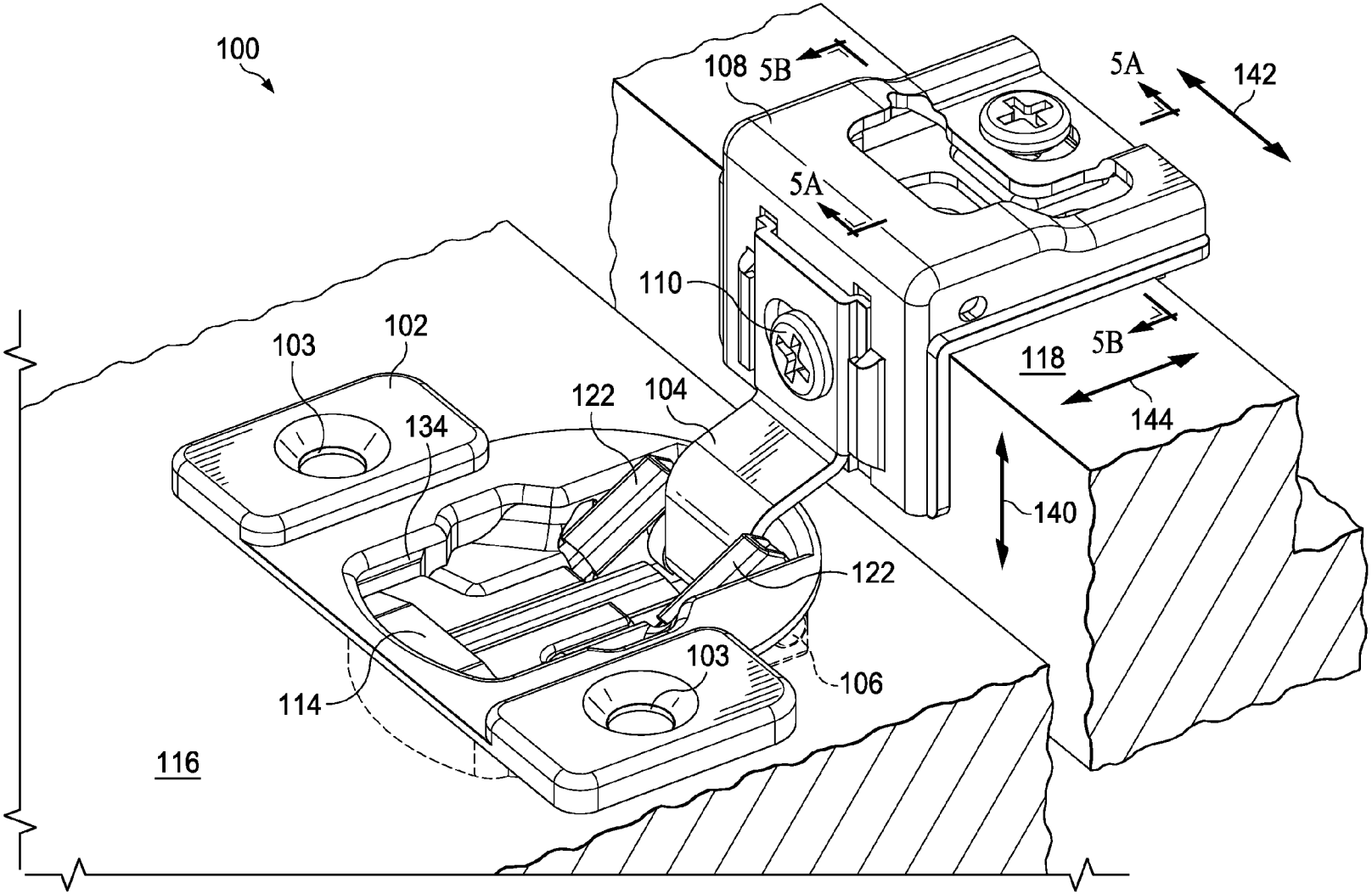
FIG. 1A an isometric view of a preferred embodiment.
Figure 1B:
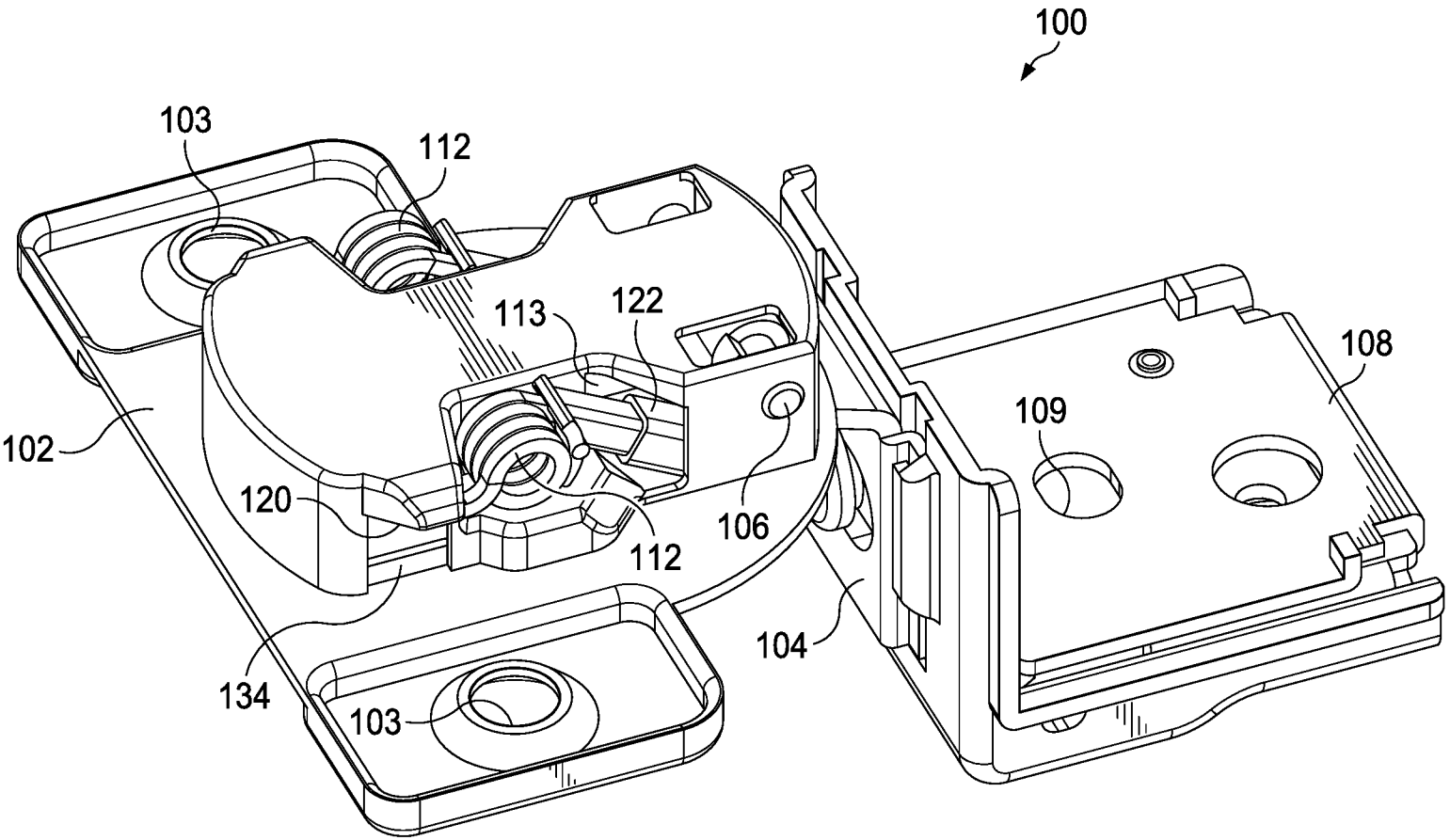
FIG. 1B is an isometric view of a preferred embodiment.
Figure 1C:
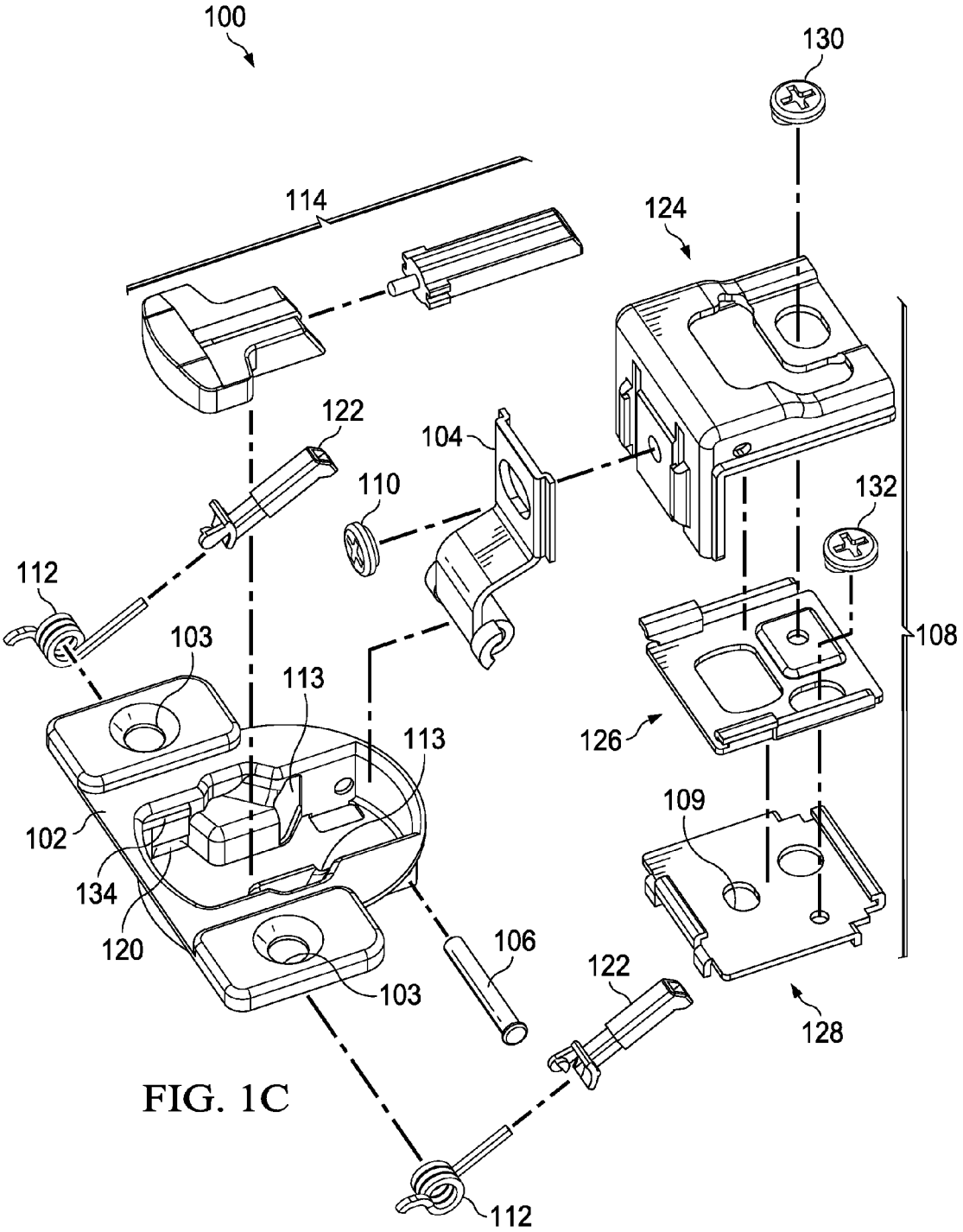
FIG. 1C is an exploded isometric view of a preferred embodiment.

Referring to FIGS. 1A-1C, hinge 100 provides a pivotal connection between cabinet door 116 and cabinet frame 118. Hinge 100 includes hinge cup 102 pivotally connected to hinge arm 104 by hinge pin 106. Hinge body 108 is adjustably connected to hinge arm 104 by overlay adjustment cam screw 110. Although a pair of springs are shown, at least one spring 112 is disposed in the hinge cup and creates a closing force on the hinge arm. One end of each spring 112 is connected to the exterior hinge cup 102 at hole 120. Hole 120 is present in both side walls of hinge cup 102. The opposite end of each spring extends through spring hole 113, encased by spring sleeve 122, into the interior of hinge cup 102 and biases hinge arm 108. Spring hole 113 is present in both side walls of hinge cup 102. Removably seated in hinge cup 102 is damping mechanism 114. Damping mechanism 114 snaps into hinge cup 102 beneath tab 134. Tab 134 extends into the interior of hinge cup 102. Tab 134 is present on both side walls of hinge cup 102 proximate hole 120. Damping mechanism 114 acts on the hinge arm during a closing movement to control the closing speed of the cabinet door.

Typically, hinge cup 102 is affixed to cabinet door 116 with screws through holes 103 and hinge body 108 is affixed to cabinet frame 118 through slot 109. It should be noted that the installation orientation with the hinge cup fitted into a bore opening on a door and the hinge arm fitted on to the frame, could be reversed even though this is not the usual practice. In a preferred embodiment, hinge cup 102, hinge arm 104, and hinge body 108 are typically constructed of metal such as cast aluminum or steel alloy plate stock and formed by stamping.

Hinge body 108 comprises overlay plate 124, adjustment plate 126, and mounting plate 128. Overlay plate 124 is adjustably connected to adjustment plate 126 by depth adjustment cam screw 130. Adjustment plate 126 is adjustably connected to mounting plate 128 by vertical adjustment cam screw 132. Each adjustment cam screw 110, 130, and 132 comprises a typical cam screw shape having a wider, cylindrical camming portion and a narrow, cylindrical offset portion extending therefrom. The separate plates of the hinge body cooperate with the adjustment can screws to provide positional adjustment of the hinge body relative to the hinge arm in an overlay or horizontal direction 140, a vertical direction 142, and a depth direction 144.

Figure 2:
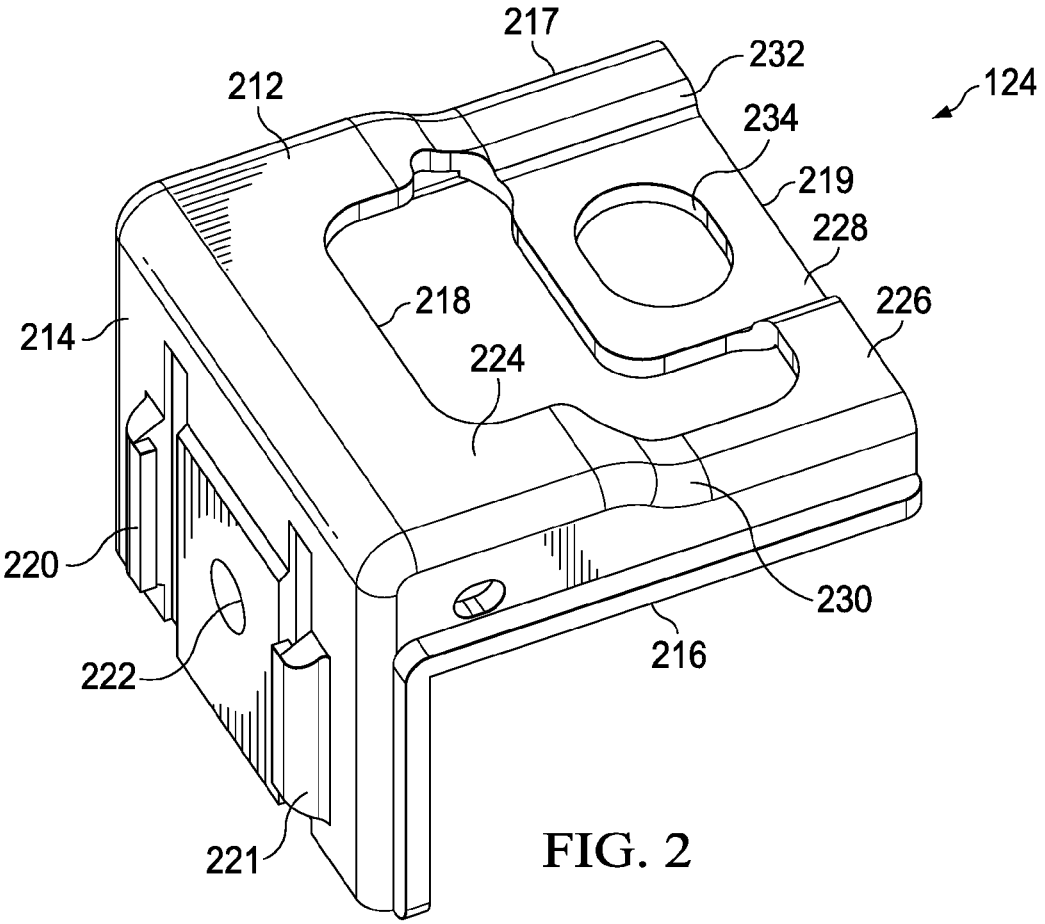
FIG. 2 is an isometric view of an overlay plate of a preferred embodiment.

Referring to FIG. 2, overlay plate 124 is generally "L" shaped comprising section 212 generally perpendicularly oriented with section 214. Section 212 is generally planar having end 219 extending between opposing edges 216 and 217. Section 212 includes three horizontal planes with sloping sections between. Plane 224 leads to plane 226 along edges 216 and 217 via slope 230. Plane 226 leads to plane 228 along end 219 via slope 232. Access opening 218 is irregularly shaped and is present in each of planes 224, 226, and 228. Plane 228 includes depth adjustment slot 234. Depth adjustment slot 234 is sized to receive the camming portion of depth adjustment cam screw 130. Section 214 is generally planar having flanges 220 and 221 extending therefrom. Flanges 220 and 221 are generally aligned with each other and disposed between them is overlay adjustment hole 222. Overlay adjustment hole 222 is sized to receive the offset portion of overlay adjustment cam screw 110.

Figure 3:
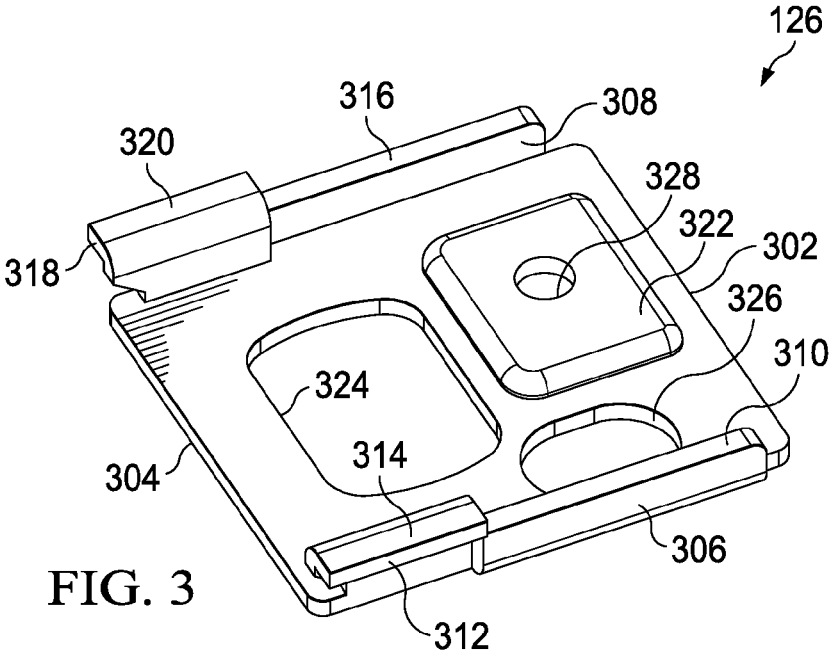
FIG. 3 is an isometric view of an adjustment plate of a preferred embodiment.

Referring to FIG. 3, adjustment plate 126 is generally planar having opposing ends 302 and 304 extending between opposing edges 306 and 308. Edge 306 includes surface 310. Tab 312 extends from edge 306 proximate end 304. Tab 312 has surface 314. Edge 308 includes surface 316. Tab 318 extends from edge 308 proximate end 304. Tab 318 has surface 320. Raised seat 322 extends from adjustment plate 126 proximate end 302. Raised seat 322 includes depth adjustment hole 328 generally aligned with depth adjustment slot 234. Depth adjustment hole 328 is sized to receive the offset portion of depth adjustment cam screw 130. Adjustment plate 126 defines access slot 324. Access slot 324 is aligned with a portion of access opening 218. Adjustment plate 126 further defines vertical adjustment slot 326. Vertical adjustment slot 326 is sized to receive the offset portion of vertical adjustment cam screw 132.

Figure 4:
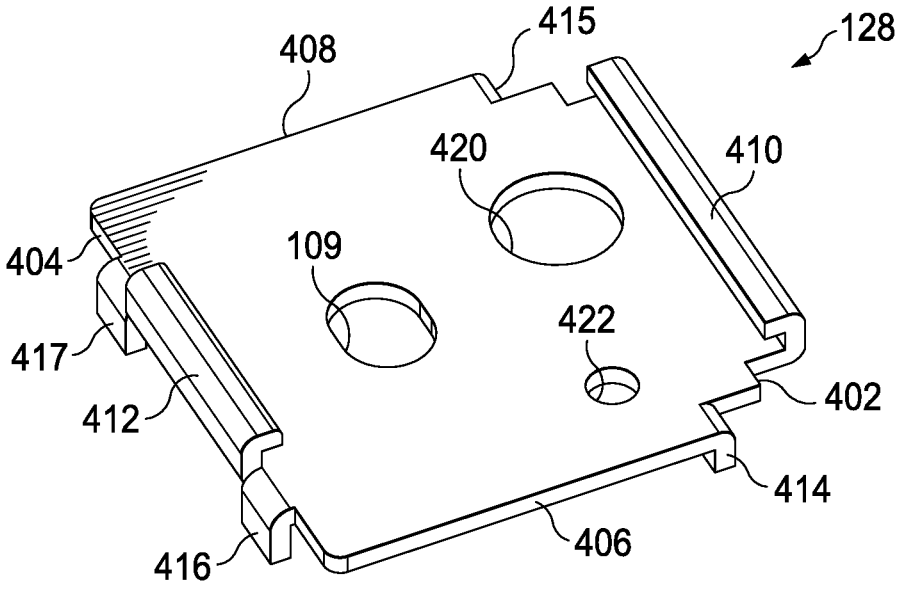
FIG. 4 is an isometric view of a mounting plate of a preferred embodiment.

Referring to FIG. 4, mounting plate 128 is generally planar having opposing ends 402 and 404 extending between opposing edges 406 and 408. End 402 includes flange 410. End 404 includes flange 412. Guide 414 extends from mounting plate 128 proximate the corner of edge 406 and end 402. Guide 415 extends from mounting plate 128 proximate the corner of edge 408 and end 402. Guides 414 and 415 are generally equidistant from end 404. Guide 416 extends from mounting plate 128 proximate the corner of edge 406 and end 404. Guide 417 extends from mounting plate 128 proximate the corner of edge 408 and end 404. Guides 416 and 417 are generally equidistant from end 402. Mounting plate 128 defines access hole 420. Access hole 420 is generally aligned with depth adjustment hole 328 to allow access to vertical adjustment screw 130 through mounting plate 128. Mounting plate 128 further defines vertical adjustment hole 422. Vertical adjustment hole is sized to receive the camming portion of vertical adjustment cam screw 132. Mounting plate 128 also defines slot 109. Slot 109 is generally aligned with access slot 324 and access hole 218 to allow access to mounting hardware (for attaching the mounting plate to the cabinet frame) through overlay plate 124 and adjustment plate 126.

Figure 5A:
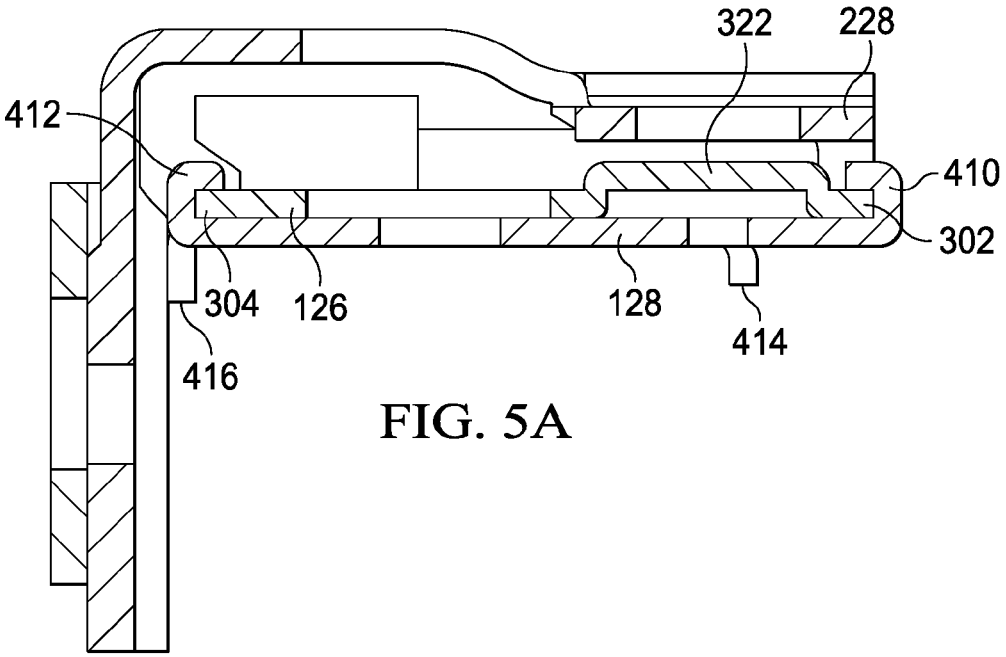
FIG. 5A is a sectional view of a hinge body of a preferred embodiment taken along line A-A of FIG. 1A.
Figure 5B:
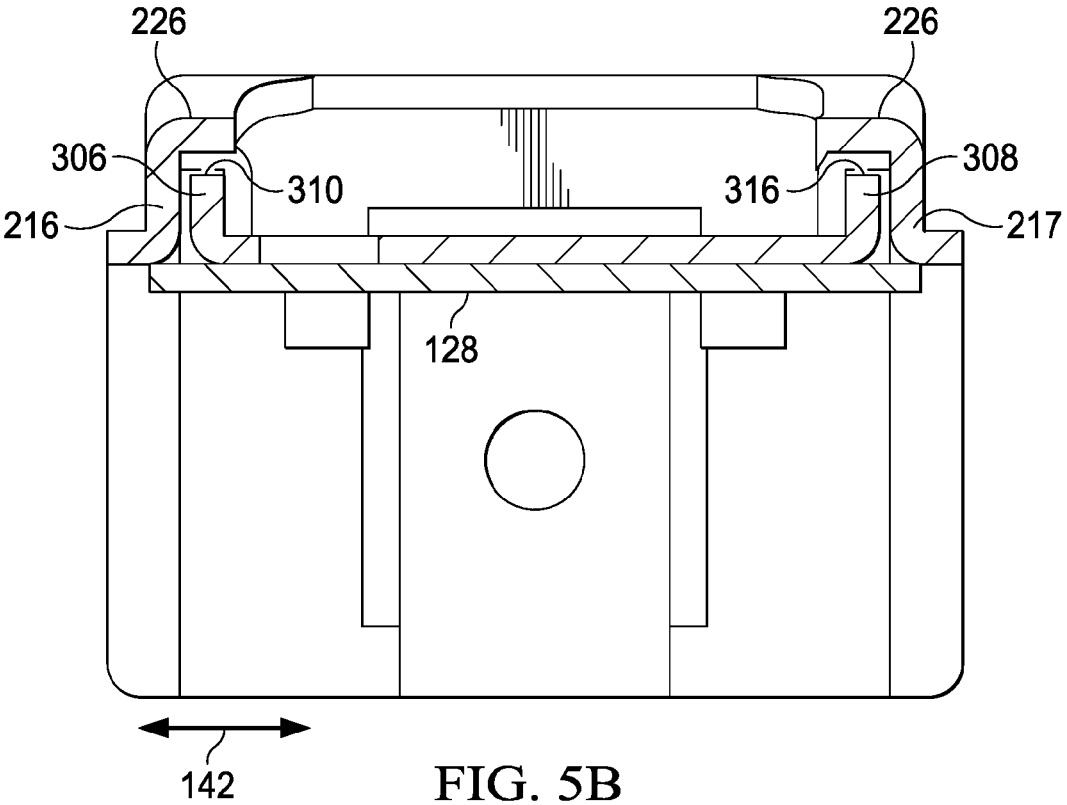
FIG. 5B is a sectional view of a hinge body of a preferred embodiment taken along line B-B of FIG. 1A.

Referring to FIGS. 5A and 5B, cross-sections of an assembled hinge body 108 are shown. Adjustment plate 126 is adjacent mounting plate 128. Ends 302 and 304 of adjustment plate 126 abut flanges 410 and 412 of mounting plate 128, respectively. Adjustment plate 126 is slidable with respect to mounting plate 128 in vertical direction 142.

Plane 228 of overlay plate 124 is adjacent raised seat 322 of adjustment plate 126. Edges 306 and 308 of adjustment plate 126 abut edges 216 and 217 of overlay plate 124, respectively. Surfaces 310 and 316 are adjacent plane 226 while surfaces 314 and 320 are adjacent plane 224. Overlay plate 124 is slidable with respect to adjustment plate 126 in depth direction 144.

Figure 6:
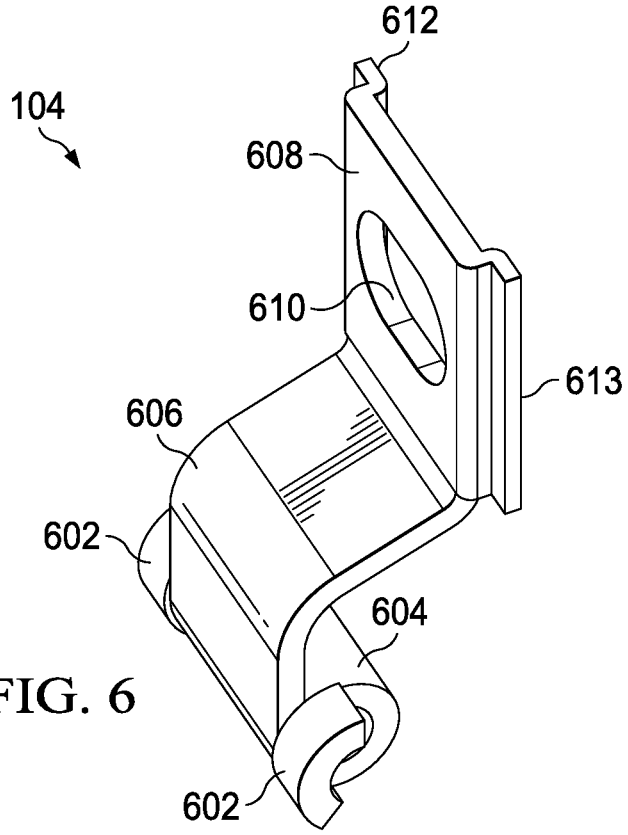
FIG. 6 is an isometric view of a hinge arm of a preferred embodiment.

Referring to FIG. 6, hinge arm 104 includes a pair of curved cam portions 602 and cylindrical sleeve 604 connected between the cam portions. Sleeve 604 is sized to receive hinge pin 106. Hinge pin 106 passes through shaft holes in hinge cup 102 and sleeve 604 to provide a pivotal connection between hinge arm 104 and hinge cup 102. Hinge arm 104 includes abutment section 606 extending from sleeve 604. Attachment section 608 is connected to abutment section 606. Attachment section 608 defines overlay adjustment slot 610. Overlay adjustment slot 610 is aligned with overlay adjustment hole 222 and is sized to receive the camming portion of overlay adjustment cam screw 110. Attachment section 608 includes flanges 612 and 613. Flanges 612 and 613 are sized to slidably engage flanges 220 and 221 of overlay plate 124. Overlay plate 124 is slidable with respect to hinge arm 104 in overlay direction 140.

Figure 7A:
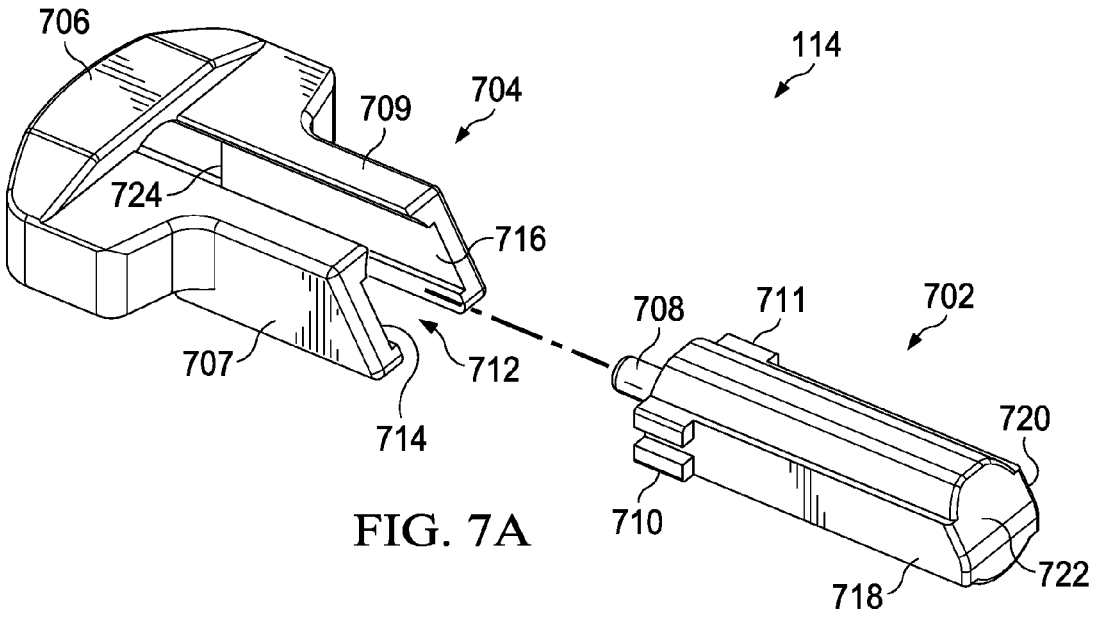
FIG. 7A is an exploded isometric view of a damping mechanism of a preferred embodiment.

Referring to FIG. 7A, damping mechanism 114 comprising cylinder 702 slidable within housing 704. Cylinder 702 is a fluid filled chamber from which piston rod 708 extends. A piston head attached to piston rod 708 moves through the fluid in cylinder 702 to provide the damping function. Cylinder 702 includes opposing flat sides 718 and 720. Side 718 has tab 710 and side 720 has tab 711. In between sides 718 and 720 and disposed opposite of piston rod 708 is face 722. Housing 704 is generally "T" shaped following the general shape of the interior of hinge cup 102. Housing 704 comprises arms 707 and 709 extending from base 706. Arms 707 and 709 form opening 712 sized to receive cylinder 702. Arms 707 and 709 include lengthwise slots 714 and 716. Slots 714 and 716 are sized to receive sides 718 and 720, respectively. Opposite opening 712, arms 707 and 709 begin with shoulder 724. Tabs 710 and 711 abut shoulder 724 to prevent the entirety of cylinder 702 from exiting housing 704 through opening 712. As assembled, face 722 extends through opening 712 and piston rod 708 extends through base 706 to abut hinge cup 102. In a preferred embodiment, housing 704 and cylinder 702 are typically constructed of injection molded plastic or polyvinyl chloride (PVC).

Figure 7B:
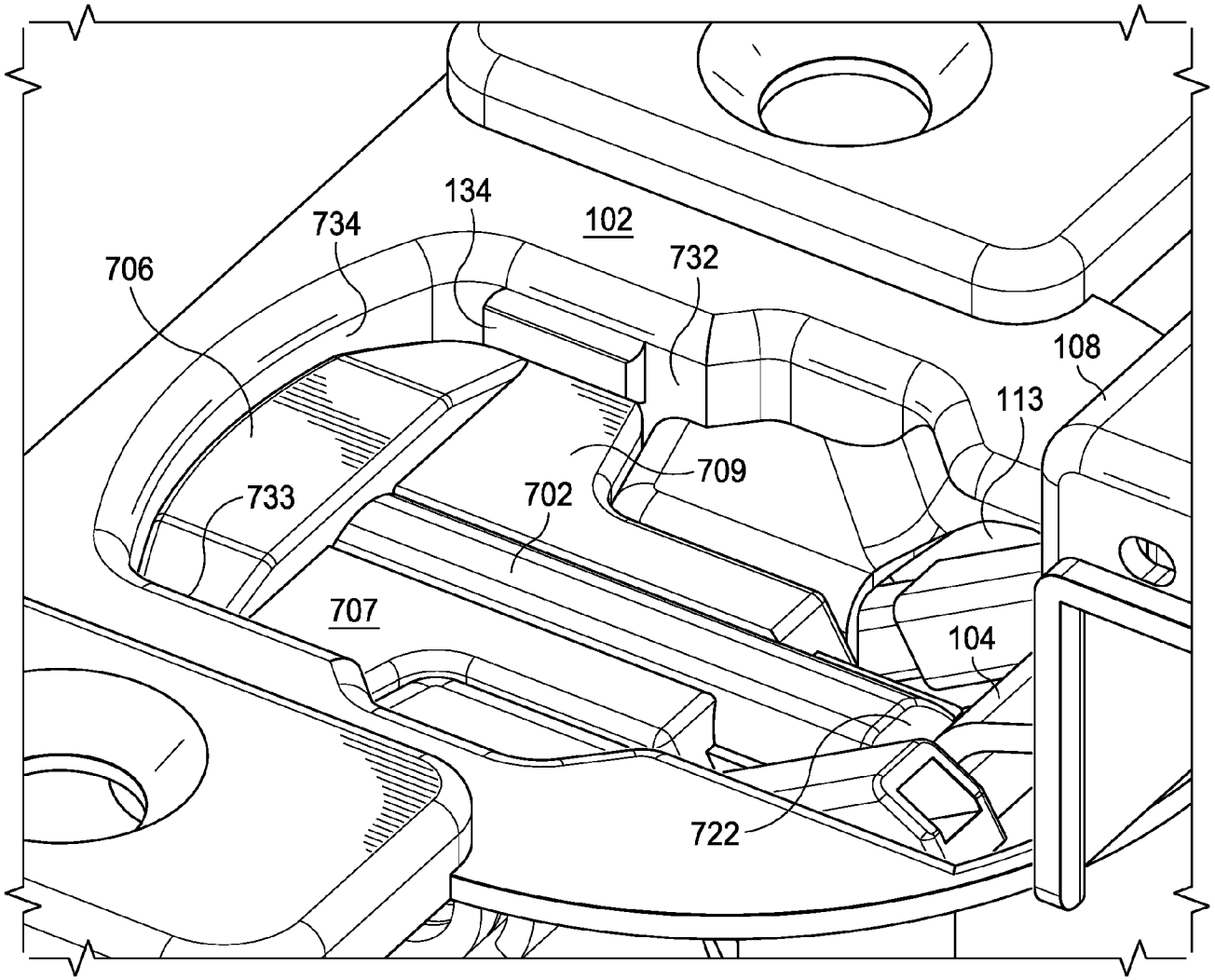
FIG. 7B is a partial isometric view of an installed damping mechanism of a preferred embodiment.

As shown in FIG. 7B, damping mechanism 114 is removably fitted to the interior of hinge cup 102. The side portions of base 706 snap in place under two opposing tabs 134 extending from side walls 732 and 733 of hinge cup 102 into the interior of hinge cup 102. Tabs 134 are stamped into the side walls of hinge cup 102 during manufacturing. When damping mechanism 114 is in position in hinge cup 102, piston 708 abuts back wall 734 of hinge cup 102. Face 722 is positioned proximate hinge arm 104.

Figure 8A:
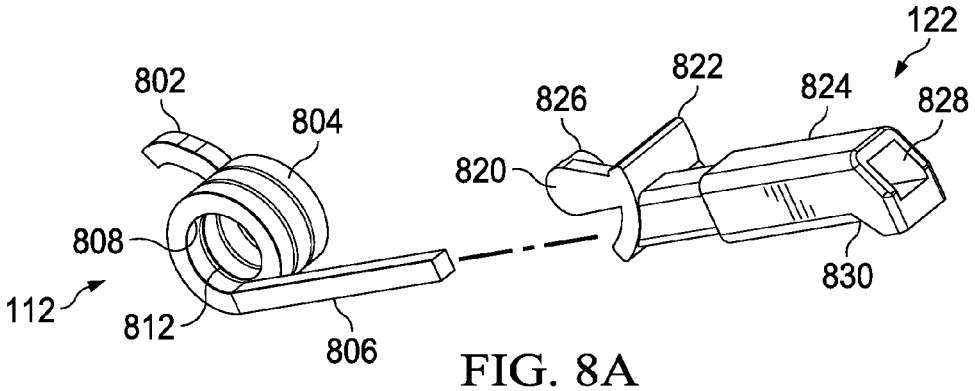
FIG. 8A is an exploded isometric view of a spring and spring sleeve of a preferred embodiment.
Figure 8B:
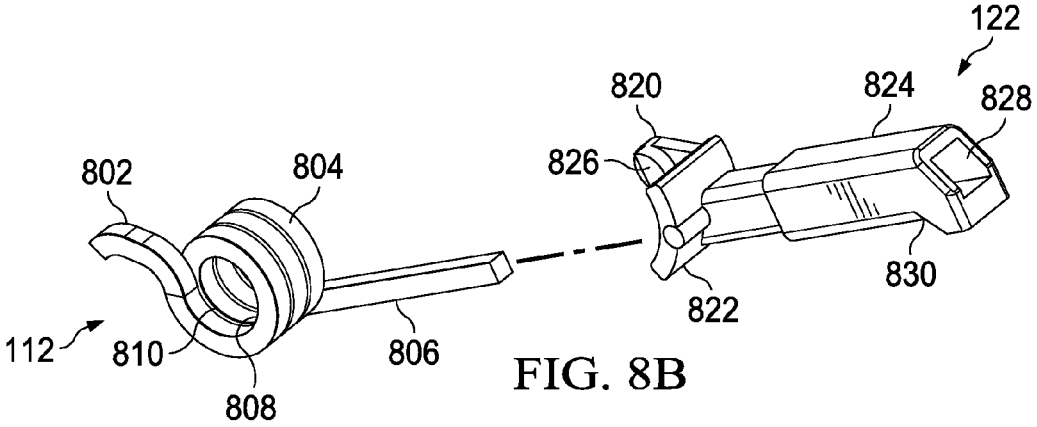
FIG. 8B is an exploded isometric view of a spring and spring sleeve of a preferred embodiment.

Referring to FIGS. 8A and 8B, springs 112 and spring sleeves 122 are shown. In the preferred embodiment, two springs and two spring sleeves are used on opposing sides of the hinge cup. Therefore, the springs and spring sleeves depicted in FIGS. 8A and 8B are mirror images of each other correlating to opposite sides of the hinge cup. For brevity, since the functions of each spring and spring sleeve combination will be the same, only one set will be discussed. However, in another preferred embodiment one spring and one spring sleeve could also be employed. Spring 112 comprises curved leg 802 connected to coiled section 804 connected to straight leg 806. Coiled section 804 forms cylindrical cavity 808. Cavity 808 has an exterior opening 810 and an interior opening 812. The cross-section of spring 112 is generally angular so as to prevent rotation of spring sleeve 122 relative to spring 112. In one preferred embodiment, the cross section is rectangular. The cross-section of spring 112 is consistent throughout curved leg 802, coiled section 804, and straight leg 806. Curved leg 802 engages hole 120 in the side wall of the hinge cup. Straight leg 806 passes through spring hole 113 and abuts cam portion 602.

Spring sleeve 122 comprises attachment portion 820 connected to stabilizing portion 822 connected to insulating portion 824. Attachment portion 820 includes head 826. Head 826 is sized to engage cavity 808 of spring 112. Stabilizing portion 822 is generally arc shaped and sized to follow the exterior curvature of coiled section 804 of spring 112 to distribute the load across the coiled section of the spring. Insulating section 824 includes chamber 828. Chamber 828 is sized to receive straight leg 806 of spring 112. The cross-section of chamber 828 is generally square or rectangular and matches the cross-section of straight leg 806. The cross-section of insulating section 824 is generally square or rectangular. One end of insulating section 824 includes curved tip 830. In a preferred embodiment, spring sleeve 122 is typically constructed of injection molded plastic or rubber.

Spring sleeve 122 is attached to spring 112. Straight leg 806 fits within chamber 828. Head 826 fits in interior opening 812 of cavity 808 while stabilizing portion 822 abuts coiled section 804. Curved tip 830 follows the curvature of cam portions 602 creating additional spring bias in order to provide a stable open position.

In use, hinge 100 provides a pivotal connection between cabinet door 116 and cabinet frame 118. Hinge cup 102 is mounted in a bore in the cabinet door through holes 103 and hinge body 108 is mounted to the cabinet frame through slot 109 with typical mounting hardware such as wood screws. Hand tools gain access to slot 109 via access opening 218 and access slot 324. Guides 414, 415, 416, and 417 abut the cabinet frame.

Hinge 100 provides adjustment in three directions after mounting without removing or loosening the mounting hardware. One direction of adjustment is the depth movement of the cabinet door. This adjustment is required when the inside face of the door does not lay flush with the cabinet frame thus impeding the opening and closing action. To effect the depth adjustment, depth adjustment cam screw 130 is rotated. As depth adjustment cam screw 130 is rotated, the camming portion of depth adjustment cam screw 130 abuts, rotates within, and slides along depth adjustment slot 234 while the offset portion of depth adjustment cam screw 130 rotates within depth adjustment hole 328. During manufacture, the offset portion of depth adjustment cam screw 130 was mushroomed via access hole 420 to prevent depth adjustment cam screw 130 from backing out of depth adjustment hole 328. Rotation of depth adjustment cam screw 130 causes hinge arm 104 and overlay plate 124 to move together in direction 144 relative to adjustment plate 126 and mounting plate 128 and the cabinet frame. Once the desired position is achieved, rotation of depth adjustment cam screw 130 is ceased.

Another direction of adjustment is the horizontal or "overlay" adjustment of the cabinet door. This adjustment is required when the vertical edges of the cabinet door do not align with the vertical edges of the cabinet frame or the vertical edges of an adjacent cabinet door or drawer. To effect the overlay adjustment, overlay adjustment cam screw 110 is rotated. As overlay adjustment cam screw 110 is rotated, the camming portion of overlay adjustment cam screw 110 abuts, rotates within, and slides along overlay adjustment slot 610 while the offset portion of overlay adjustment cam screw 110 rotates within overlay adjustment hole 222. During manufacture, the offset portion of overlay adjustment cam screw 110 was mushroomed to prevent removal of overlay adjustment cam screw 110 from overlay adjustment hole 222. Rotation of overlay adjustment cam screw 110 causes hinge arm 104 to move in direction 140 relative to hinge body 108 and the cabinet frame. Once the desired position is achieved, rotation of overlay adjustment cam screw 110 is ceased.

Another direction of adjustment is the vertical adjustment of the cabinet door. This adjustment is required when the horizontal edges of the cabinet door do not align with the horizontal edges of the cabinet frame or the horizontal edges of an adjacent cabinet door or drawer. To effect the vertical adjustment, vertical adjustment cam screw 132 is rotated. As vertical adjustment cam screw 132 is rotated, the camming portion of vertical adjustment cam screw 132 abuts, rotates within, and slides along vertical adjustment slot 326 while the offset portion of vertical adjustment cam screw 132 rotates within vertical adjustment hole 422. During manufacture, the offset portion of vertical adjustment cam screw 132 was mushroomed to prevent removal of vertical adjustment cam screw 132 from vertical adjustment hole 422. Rotation of vertical adjustment cam screw 132 causes hinge arm 104, overlay plate 124, and adjustment plate 126 to move together in direction 142 relative to mounting plate 128 and the cabinet frame. Once the desired position is achieved, rotation of vertical adjustment cam screw 132 is ceased.

During a closing motion, springs 112 provide a closing force. Damping mechanism 114 opposes the closing force and controls the closing speed of the cabinet door so that the cabinet door does not slam. Damping mechanism 114 is removably snapped into hinge cup 102 as base 706 fits under tabs 134. As the cabinet door closes, abutment section 606 abuts face 722 and forces cylinder 702 through housing 704 while housing 704 remains stationary relative to hinge cup 102. Since piston rod 708 abuts back wall 734, as cylinder 702 moves through housing 704, the piston head attached to piston rod 708 moves through the fluid in cylinder 702 to provide the soft-close functionality.

The closing force provided by springs 112 is a result of straight leg 806 biasing hinge arm 104 via cam portion 602. In a typical setup, during a closing movement, straight leg 806 rides on cam portion 602. Hinge 100 includes spring sleeve 122. Straight leg 806 is encased by insulating portion 824 of spring sleeve 122. With spring sleeve 122 installed on spring 112, insulating portion 824 rides on cam portion 602 instead thus reducing wear on and extending the usable life of spring 112 and hinge arm 104. Spring sleeve 122 also eliminates any noise created by the movement of spring 112 along cam portion 602.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

The invention claimed is:

1. A soft-close hinge for pivotally connecting a cabinet door to a cabinet frame comprising:

a hinge cup pivotally connected to a hinge arm, the hinge cup having a first side wall and a second side wall defining an interior;

a first tab extending from the first side wall into the interior;

a second tab extending from the second side wall into the interior;

a hinge body adjustably connected to the hinge arm;

a damping mechanism removably seated in the interior and anchored between the first tab and the second tab;

a coil spring, having an angular cross-section and connected to at least one side wall of the pair of side walls, biasing the hinge cup toward the hinge arm;

a spring sleeve attached to the coil spring and adjacent the hinge arm;

wherein a position of the hinge arm relative to the cabinet frame is adjustable in a first direction, a second direction, and a third direction;

an overlay plate adjustably connected to the hinge arm by an overlay cam screw;

an adjustment plate adjustably connected to the overlay plate by a depth cam screw;

a mounting plate adjustably connected to the adjustment plate by a vertical cam screw;

wherein rotation of the overlay cam screw causes the first direction to be a horizontal direction;

wherein rotation of the depth cam screw causes the second direction to be a depth direction; and, wherein rotation of the vertical cam screw causes the second direction to be a vertical direction.

2. The soft-close hinge of claim 1, wherein the hinge body further comprises:

an overlay plate having a first planar surface aligned with a second planar surface and a third planar surface;

an access opening in the first planar surface, the second planar surface, and the third planar surface;

a depth adjustment slot in the first planar surface;

an adjustment plate connected to the overlay plate at the first planar surface by a depth cam screw; and, a mounting plate connected to the adjustment plate.

3. The soft-close hinge of claim 1, wherein the hinge body further comprises:

an overlay plate, having an overlay hole and a depth slot, connected to the hinge arm by an overlay cam screw rotatable in the overlay hole;

an adjustment plate, having a depth hole and a vertical slot, connected to the overlay plate by a depth cam screw rotatable in the depth slot and the depth hole;

a mounting plate, having a vertical hole, connected to the adjustment plate by a vertical cam screw rotatable in the vertical slot and the vertical hole;

wherein rotation of the overlay cam screw adjusts the position of the hinge arm relative to the cabinet frame in a horizontal direction;

wherein rotation of the depth cam screw adjusts the position of the hinge arm relative to the cabinet frame in a depth direction; and, wherein rotation of the vertical cam screw adjusts the position of the hinge arm relative to the cabinet frame in a vertical direction.

4. The soft-close hinge of claim 1, wherein the damping mechanism further comprises:

a housing having a first arm and a second arm extending from a base, the first arm and the second arm defining an opening and the base releasably engaged with each tab;

a fluid filled cylinder slidably engaged with the housing between the first arm and the second arm and extending through the opening to abut the hinge arm and extending through the base to abut the hinge cup.

5. A soft-close hinge for pivotally connecting a cabinet door to a cabinet frame comprising:

a hinge cup pivotally connected to a hinge arm, the hinge cup having a first side wall and a second side wall defining an interior;

a first tab extending from the first side wall into the interior;

a second tab extending from the second side wall into the interior;

a hinge body adjustably connected to the hinge arm;

a damping mechanism removably seated in the interior and anchored between the first tab and the second tab;

a coil spring, having an angular cross-section and connected to at least one side wall of the pair of side walls, biasing the hinge cup toward the hinge arm;

a spring sleeve attached to the coil spring and adjacent the hinge arm; and, wherein a position of the hinge arm relative to the cabinet frame is adjustable in a first direction, a second direction, and a third direction.

6. The soft-close hinge of claim 5 wherein the hinge body further comprises:

an overlay plate adjustably connected to the hinge arm;

an adjustment plate adjustably connected to the overlay plate; and, a mounting plate adjustably connected to the adjustment plate.

7. The soft-close hinge of claim 5 wherein the coil spring further comprises:

a curved leg extending from a coil section and restrained by at least one side wall of the pair of side walls;

a straight leg extending from the coil section; and, the spring sleeve connected to the coil section and encasing the straight leg.

8. The soft-close hinge of claim 5 wherein the spring sleeve further comprises:

an attachment portion extending from a stabilizing portion, attached to the coil spring;

an insulating portion extending from the stabilizing portion; and, wherein the insulating portion encases the coil spring.

9. The soft-close hinge of claim 5 further comprising:

wherein the coil spring has a curved leg extending from a coil section and a straight leg extending from the coil section, the curved leg connected to at least one side wall of the pair of side walls;

wherein the spring sleeve has an attachment portion extending from a stabilizing portion and an insulating portion extending from the stabilizing portion, the attachment portion attached to the coil section; and, wherein the insulating portion encases the straight leg.

10. The soft-close hinge of claim 5 wherein the damping mechanism further comprises:

a housing abutting each tab; and, a cylinder, adjacent the hinge arm and the hinge cup, slidably engaged with the housing.

11. The soft-close hinge of claim 5 wherein the hinge arm further comprises:

a first end having a cylindrical sleeve connected between a set of curved cam portions;

a second end having a first set of flanges;

the hinge body having a second set of flanges;

the first set of flanges slidably engaged with the second set of flanges; and, the spring sleeve abuts at least one cam portion of the set of curved cam portions.

12. The soft-close hinge of claim 5 wherein:

the hinge cup is configured to be mounted to the cabinet door;

the hinge body is configured to be mounted to the cabinet frame with a wood screw; and, the adjustment of the position of the hinge arm relative to the cabinet frame is accomplished without loosening the wood screw.

13. A method of damping the closing movement of a compact hinge having a hinge cup pivotally connected to a hinge arm, an overlay plate connected to the hinge arm by an overlay screw, an adjustable plate connected to the overlay plate by a depth cam screw, a mounting plate connected to the adjustable plate by a vertical cam screw, a housing abutting a set of tabs extending from the hinge cup, a damping cylinder slidably engaged with the housing and adjacent the hinge arm, a coil spring with an angular cross-section attached to the hinge cup biasing the hinge cup toward the hinge arm, and a spring sleeve encasing the coil spring comprising:

providing a closing force to the compact hinge to begin the closing movement;

abutting the cylinder with the hinge arm;

moving the cylinder through the housing;

pressing the spring sleeve on the hinge arm; and, whereby a closing speed of the compact hinge is controlled.

14. The method of claim 13 wherein the hinge arm further includes a set of cam portions and the method further comprises the step of:

biasing the spring sleeve toward at least one cam portion of the set of cam portions.

15. The method of claim 13 further comprising:

rotating the vertical cam screw to adjust a vertical position of the hinge arm relative to the mounting plate.

16. The method of claim 13 further comprising:

rotating the depth cam screw to adjust a depth position of the hinge arm relative to the mounting plate.

17. The method of claim 13 further comprising:

rotating the overlay cam screw to adjust a horizontal position of the hinge arm relative to the mounting plate.

18. A compact, soft-close hinge for pivotally connecting a cabinet door to a cabinet frame comprising:

a hinge cup defining an interior and having a set of tabs extending into the interior, the hinge cup connected to a hinge arm;

an overlay plate adjustably connected to the hinge arm by an overlay cam screw;

a first set of flanges on the hinge arm slidably engaged with a second set of flanges on the overlay plate;

an adjustment plate adjustably connected to the overlay plate by a depth cam screw;

a mounting plate adjustably connected to the adjustment plate by a vertical cam screw;

a damping mechanism having a housing slidably engaged with a cylinder, the housing seated in the interior and adjacent the set of tabs, the cylinder abuttable by the hinge arm;

a set of coil springs biasing the hinge cup toward the hinge arm, where each coil spring of the set of coil springs has an angular cross-section;

wherein a position of the hinge arm relative to the mounting plate is adjustable in a first direction, a second direction, and a third direction.

19. The compact, soft-close hinge of claim 18, further comprising:

a set of spring sleeves engaging the hinge arm, where each spring sleeve of the set of spring sleeves has an angular shaped chamber encasing a coil spring of the set of coil springs.

20. The compact, soft-close hinge of claim 19 further comprising:

the hinge arm defines an overlay adjustment slot positioned between the first set of flanges;

the overlay plate defines a depth adjustment slot and an overlay adjustment hole positioned between the second set of flanges;

the adjustment plate defines a depth adjustment hole and a vertical adjustment slot;

the mounting plate defines a vertical adjustment hole;

the overlay cam screw rotatably engaged with the overlay adjustment hole and the overlay adjustment slot;

the depth cam screw rotatably engaged with the depth adjustment hole and the depth adjustment slot;

the vertical cam screw rotatably engaged with the vertical adjustment hole and the vertical adjustment slot;

wherein rotation of the overlay cam screw adjusts the position of the hinge arm relative to the mounting plate in a horizontal direction;

wherein rotation of the depth cam screw adjusts the position of the hinge arm relative to the mounting plate in a depth direction; and, wherein rotation of the vertical cam screw adjusts the position of the hinge arm relative to the mounting plate in a vertical direction.

* * * * *